United States Patent [19]

Sluzallek

[11] Patent Number: 4,569,487

[45] Date of Patent: Feb. 11, 1986

[54] BAND STORING MACHINE

[75] Inventor: Rolf Sluzallek, Düsseldorf, Fed. Rep. of Germany

[73] Assignee: Dr. Weusthoff GmbH, Düsseldorf, Fed. Rep. of Germany

[21] Appl. No.: 620,018

[22] Filed: Jun. 13, 1984

[30] Foreign Application Priority Data

Jun. 16, 1983 [DE] Fed. Rep. of Germany ..... 3321786

[51] Int. Cl.[4] ..... B65H 17/48; B65H 17/02

[52] U.S. Cl. ..... 242/55; 242/55.19 R

[58] Field of Search ..... 242/55, 55.19 R, 55.18, 242/78.1, 78.6

[56] References Cited

U.S. PATENT DOCUMENTS

| | | | |
|---|---|---|---|
| 3,273,814 | 9/1966 | Prusak et al. | 242/55 |
| 3,341,139 | 9/1967 | LaTour | 242/55 |
| 3,782,662 | 1/1974 | Miller | 242/55 |
| 3,888,430 | 6/1975 | Costello et al. | 242/55 |
| 4,012,005 | 3/1977 | Hattersley, Jr. | 242/55 |
| 4,092,007 | 5/1978 | Weatherby et al. | 242/55.19 R |
| 4,163,527 | 8/1979 | Hood et al. | 242/55 |

FOREIGN PATENT DOCUMENTS

| | | | |
|---|---|---|---|
| 1924542 | 11/1970 | Fed. Rep. of Germany | 242/55 |

*Primary Examiner*—Stuart S. Levy
*Assistant Examiner*—Lloyd D. Doigan
*Attorney, Agent, or Firm*—Becker & Becker, Inc.

[57] ABSTRACT

A band storing machine for temporarily storing band-like material in a continuously operating process line, for example by the feeding of sheet metal in band-like form to tube welding machines. The machine has two concentrically arranged roller baskets or cages for winding up the band; withdrawal of the band is effected via a lateral displacement guide which is disposed in the inner basket. The problem of buckling and otherwise adversely affecting the path of the band is to be avoided, and the band is to be treated as gently as possible. This can be done, and the band can therefore be transported in the storing machine merely by pulling, by rotatably disposing the outer roller basket about the inner roller basket, and by initially guiding the band from the uncoiling location to the processing machine in a so-called by-pass between and through the rollers transverse to the circular disk formed by the roller baskets and about the lateral displacement guide. This can be done as long as storage is not required, whereas when storage is required the outer roller basket rotates as a loading basket, and the band is pulled and wound onto the concentric roller baskets via at least one loading roller.

3 Claims, 4 Drawing Figures

BAND STORING MACHINE

BACKGROUND OF THE INVENTION

1. Field of the Invention

The present invention relates to a band storing machine for temporarily storing band-like material in a continuously operating process line, for example by the supply of sheet metal in band-like form to tube welding machines. The band storing machine has two concentrically arranged roller baskets or cages for winding up the band; withdrawal of the band is effected via a lateral displacement guide disposed in the inner basket.

The purpose of band storing machines is to made possible the stationary connection of the next band to the end of the preceding band without having to halt the operation of the processing line. In the steel and nonferrous metal industry, this involves welding a new coil onto the end edge of a coil which is in the process of being processed, for example in the manufacture of straight bead welded tubes. The preparation of the band ends, and the welding on of a new coil, requires approximately 2–4 minutes during which the joint and welding area are essentially not allowed to be moved.

2. Description of the Prior Art

Heretofore known band storing machines are in the form of loop-forming pits, loop-forming structures, or loop-forming carriages. One of the drawbacks of such heretofore known band storing machines is that they require a large amount of space.

Also known is a band storing machine having horizontal band guidance, i.e. the band is supported in the storing machine on a horizontal edge. The storing machine thus has the form of an upright cylinder in which the band forms a spiral. A so-called called pusher is provided to transport the band; the so-called pusher effects a feeding action by pushing the band into the cylinder. This requires an appropriate stiffness of the band material, so that the band must have a certain minimum thickness. A further drawback of this device is that the supporting band edge is often damaged and that relative movements occur between the individual band windings.

A number of the drawbacks of the aforementioned known band storing machines are avoided by a machine which has become known as a free loop band storing machine. This type of machine includes the initially mentioned general features, namely two concentrically arranged roller baskets, which with this heretofore known machine are rigidly disposed about a horizontal central axis, so that what is involved is a horizontal drum which cannot, however, move on its own. Here, too, the band is pushed into the storing machine by means of a pusher, and in particular initially onto the inside of the outer roller basket, where it forms a band winding which increases toward the outside. From there, the band passes via a freely rotating band loop to the outer side of the inner roller basket, where it similarly forms a band winding. The band leaves the storing machine via the lateral displacement guide which is disposed in the inner basket, and from there passes to the processing machine. This heretofore known type of band storing machine has a relatively great storage capacity relative to the room which it requires. However, a drawback to this known machine is that it still requires the pushing feed of the band into the storing machine. Under certain band characteristics, there is not possible to avoid compression of the band or to prevent the band from breaking away to the side. Furthermore, with fin bands there exists the danger that the outer band winding, in the upper region of the outer basket, will drop down under its own weight, thus obstructing the freely rotating band loop.

An object of the present invention is to provide a band storing machine of the aforementioned general type in which the band is transported by being pulled, and on the whole is handled particularly gently. At the same time, the advantage of a large storage capacity in a small amount of space should be maintained.

BRIEF DESCRIPTION OF THE DRAWINGS

These objects, and other objects and advantages of the present invention, will appear more clearly from the following specification in conjunction with the accompanying drawings, in which.

SUMMARY OF THE INVENTION

Figure 1:
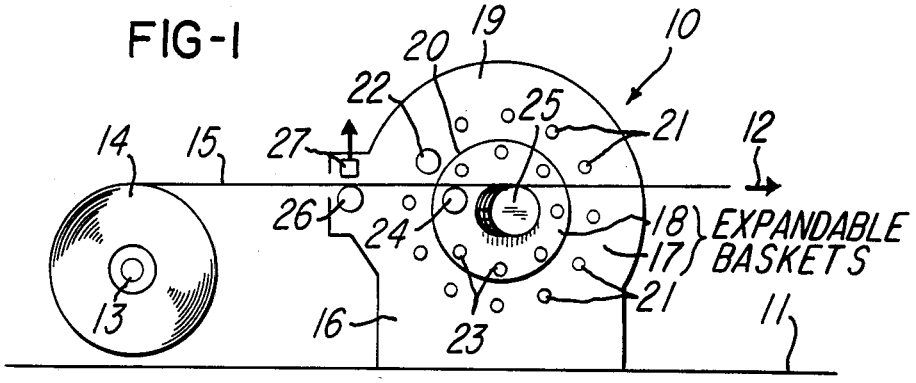
FIG. 1 is a simplified and partially schematic side view of one embodiment of the inventive loading basketband storing machine shown with a full coil and in by-pass operation.

The band storing machine of the present invention is characterized primarily in that the outer roller basket is rotatably disposed about the inner roller basket, and in that the band is initially guided to the processing machine from the winding location in a so-called by-pass between and through the rollers transverse to the circular disk formed by the roller baskets and about the lateral displacement guide; this takes place as long as storage is not required, whereas when storage is required the outer roller basket rotates as a loading basket, and the band is pulled and wound onto the concentric roller baskets by at least one loading roller.

Pursuant to further advantageous features of the present invention, the roller baskets may be spreadable. Furthermore, the central axis of the concentric roller baskets may be horizontally disposed.

The outer roller basket may include an annular mounting plate, the central opening of which may encircle the mounting plate of the inner roller basket. One side of the mounting plate of the outer roller basket may support outer rollers which are disposed on a circle and which have spindles which extend at right angles to the last mentioned mounting plate. The two mounting plates may be aligned with one another.

The loading roller of the outer roller basket may have a larger diameter than do the rollers which are intended for support of the outer band winding.

Direction-imparting auxiliary rollers may be disposed on one or both sides of the band storing machine beyond the outer roller basket in the straight line of the by-pass guidance of the band. The auxiliary roller, which is disposed ahead of the entry of the band into the roller baskets, may be combined with a band stopper. The lateral displacement guide, which is disposed in the inner roller basket, and the auxiliary rollers, which are disposed beyond the roller baskets, may have those surfaces which guide the band disposed in the same plane. The by-pass plane for the band may extend transversely through the upper third of the inner roller basket. In the inner roller basket, at that location where the band enters the latter, there may be disposed a supporting and direction-changing roller, the operational surface of which is aligned with the by-pass plane and during storing operation reverses the direction of the band as it is being withdrawn from the inner winding toward the lateral displacement guide. During by-pass operation, the loading roller may be disposed in readiness for the storage operation near the supporting and direction-changing roller of the inner roller basket above the band.

In contrast to the heretofore known spiral band storing machines, the advantage is obtained with the present invention that the band can extend linearly, with the exception of the necessary lateral displacement guidance, during the time in which storage is not necessary because the end of the coil is not present; this is the case because the band passes through the two roller baskets in a so-called by-pass. A very important gentle handling of the band is connected with this inventive operation, which shows up in the quality of the product made from the band. This also comes about because the band is only transported through the storing machine by being pulled, not only during by-pass operation but also during storing operation. As a result, the material of the band is also stressed considerably less than is the case with the heretofore known storing machines. Furthermore, due to this manner of handling of the bands, bands having critical characteristics also can be processed, which, up to now, has not been the case. This is one result of the rotating outer roller basket which operates as the active loading basket. The expense for a pusher in conformity with the known free loop band storing machines is eliminated.

DESCRIPTION OF PREFERRED EMBODIMENTS

Referring now to the drawings in detail, shown is a band storing machine 10, which is incorporated in a band steel processing line, the further components of which are not shown in the drawing. The machine 10 is placed on a workshop floor 11, and in the illustrated embodiment operates in the direction of the arrow 12 from the left to the right. Disposed ahead of the machine 10 is an unwinding or uncoiling device 13 for band steel coils 14, from which a band 15 which is to be processed is withdrawn, is conveyed through the machine 10, and is conveyed to the next station of the processing line in the direction of the arrow 12. In the case of a manufacturing line for producing straight bead welded tubes, the band 15, beyond the arrow 12, passes into a non-illustrated moving-up device, which furnishes the pulling force for conveying the band 15 through the band storing machine 10.

The machine 10 has a base 16 on which are mounted two roller baskets or cages, namely an outer or loading basket 17 and an inner basket 18. Although the inner basket 18 is fixed, i.e. is mounted so that it cannot rotate, the outer basket 17 can rotate about the inner basket 18, since it is appropriately rotatably mounted. The common central axis for both of the baskets 17, 18 extends horizontally, resulting in an upright arrangement of the band storing mechanism, with the band 15 being guided in a flat or horizontal manner.

The roller baskets comprise circular mounting plates one to which are mounted at right angles thereto rollers which are disposed along a circle and rotate on appropriate spindles. The outer basket 17 has a circular mounting plate 19, the central opening of which encircles a circular-disk-shaped mounting plate 20 of the inner basket 18. The two mounting plates 19, 20 are aligned with one another. The mounting plate 19 of the outer or loading basket 17 supports a ring of, for example twenty-four supporting rollers 21, of which, for the purpose of simplifying the drawing, only eleven are illustrated. The mounting plate 19 further supports a loading roller 22, which has a greater diameter than do the supporting rollers 21. The mounting plate 20 of the inner basket 18 is equipped with, for example, thirteen (seven shown in the drawing) supporting rollers 23, and a supporting and direction-changing roller 24 which assumes a fixed position; this latter feature will be discussed in greater detail subsequently.

In the center of the inner basket 18, on the mounting plate 20, there is mounted a lateral displacement guide 25 in the form of a shaft which has a relatively large diameter and which is mounted at an angle to the central axis of the roller baskets 17, 18 in the direction toward the arrow 12. The band 15 is looped once around the guide 25, so that it is displaced toward the open side of the roller baskets (FIG. 2), and in particular to such an extent that the band 15 exits the ring of rollers 21, 23.

Ahead of the machine 10, along the path of the band 15 from the coil 14 to the outer or loading basket 17, there is arranged a crosscutting and welding machine for producing band connections. Disposed on the machine 10 is an auxiliary roller 26 which has a band stopper 27; the band 15 passes between the roller 26 and the stopper 27. Such an auxiliary roller also can be provided on the opposite side of the outer basket 17; however, in the illustrated embodiment, this is not necessary.

To drive the loading basket 17 during its rotation about the inner basket 18 a non-illustrated electric motor is provided which is located on the back side of the machine 10 and is controlled in a manner which will be subsequently described. The rollers 21, 22, 23, 24, and 26 are, as such, not driven, but rather turn as a result of the action of the band 15 which runs over them. The lateral displacement guide 25 also does not have its own drive. Finally, the same is true for the uncoiling device 13 having the coil 14.

Figure 4:
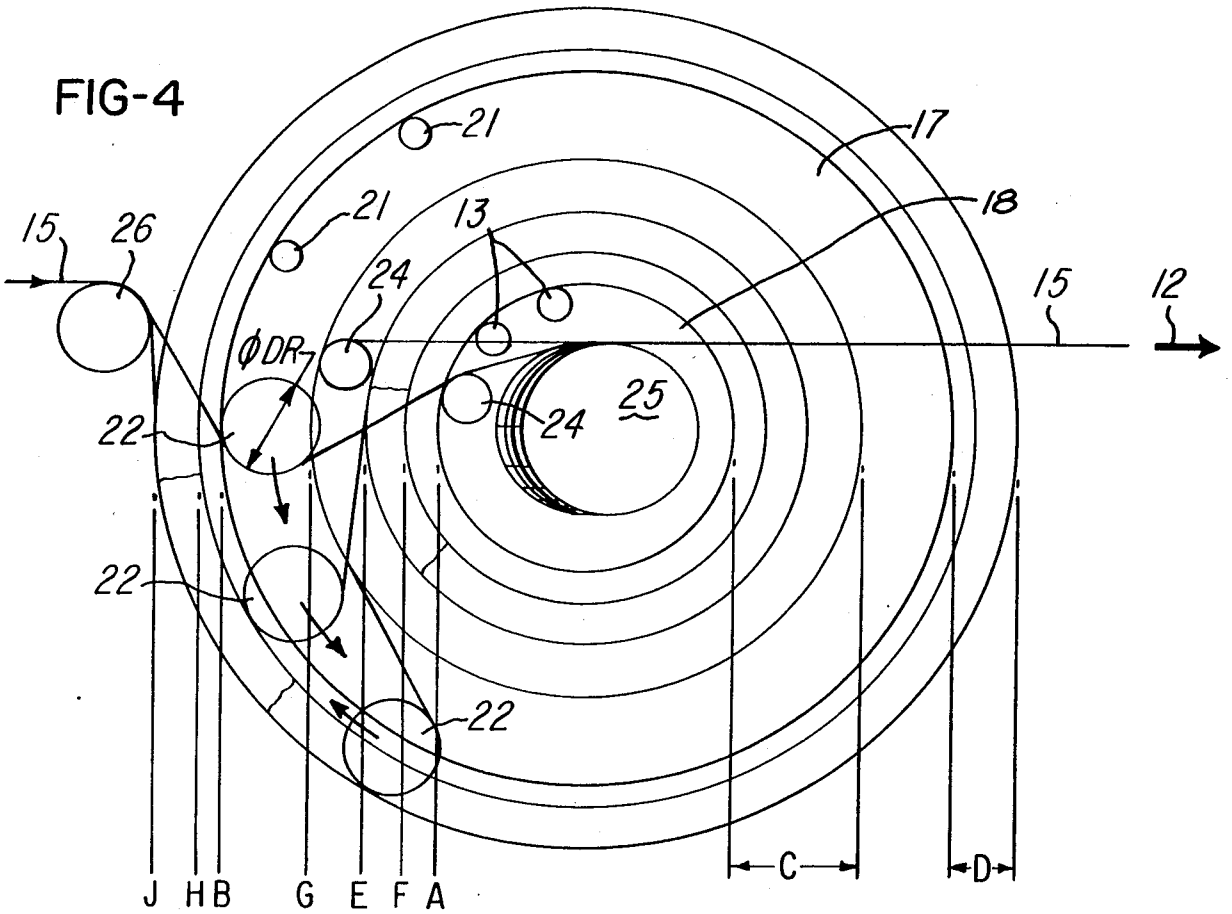
FIG. 4 shows the roller positions of the roller baskets in various storing phases.

Not illustrated in the drawing, yet functionally recognizable from FIG. 4, are conventional expanding devices for the roller baskets 17, 18. As a result of these devices, each roller of the baskets can be moved a certain extent along a radial line on the pertaining mounting plate 19, 20, so that the increasing diameters of the belt windings located on the roller baskets are appropriately taken into consideration. The expansion of the rollers, for example, can be effected by pneumatic devices, with the rollers 21, 22, 23, and 24 appropriately following the increasing inner diameters of the band windings.

The thickness of the sheet metal bands which are to be processed is generally greater than 0.2 mm. Depending upon this thickness, a tube line is operated at speeds of between approximately 25 and 180 m/min. The speed at which the band is fed into the band storing machine can at times reach 500 m/min. Up to about 1000 m of band can be accommodated in the machine of the type under consideration.

The described band storing machine of the present invention operates as follows:

As can be seen in FIG. 1, the band 15 is introduced from the coil 14 into the band storing machine 10 in the direction of the arrow 12. In so doing, the band 15 extends through the machine in a straight line, and is wound about the lateral displacement guide 25 approximately in the middle of the machine. As it enters the machine, the band 15 rests upon the auxiliary roller 26 and then travels through below the loading roller 22 after which it is again supported upon the supporting and direction-changing roller 24. In the vicinity of the arrow 12, the band is grasped by the non-illustrated moving-up device of the subsequent tube welding machine. The important thing is the location shown in FIG. 1 of the loading roller 22 relative to the band 15, which otherwise extends through freely between the supporting rollers 21, 23 of the roller baskets 17. This free path of the band 15 will be designated as a by-pass, because it detours those components of the machine 10 which are intended for storing.

The situation shown in FIG. 1 represents the stand-by position of the band storing machine. In this position, the band 15 is withdrawn from the processing machine practically directly from the coil 14 without the roller baskets 17, 18 coming into play; the band 15 is simply pulled through the machine 10. This assures the greatest careful treatment of the band and the band storing machine, as well as a corresponding saving of energy.

Storing is only initiated when the coil 14, during bypass operation, is unwound to such an extent that there is only located thereon that length of band which is just sufficient for filling the storing machine; at this point, the machine automatically changes over from by-pass operation to storing operation. This is effected by a starting signal resulting from the cooperation of a non-illustrated pulse transmitter, which follows on the band 15, with a similarly non-illustrated pulse switch on the uncoiling device 13. The storing process is automatically initiated as a function of the inner diameter of the coil 14 which is supported at any given time. The required values are input into a control device (not illustrated), after they are taken from a chart. As a result, start of the band storing always takes place at the right moment, so that the storing task can be fulfilled with the objective of a reliable connection of the next band.

After the starting signal, the loading basket 17 is rotated, and in particular, according to FIG. 1, in a counterclockwise direction, whereupon the storing machine is loaded with a supply of band. The loading roller 22 rests against the band 15 from above and pulls it downwardly between the auxiliary roller 26 and the supporting and direction-changing roller 24 (see FIG. 4) and left around in a circle not only along the outside of the supporting rollers 21 of the outer or loading basket 17, but also along the outer side of the supporting rollers 23 of the inner basket 18, so that as the loading basket 17 with the loading roller 22 rotates several times, a respective band roll or winding 28, 29 is formed on each of the baskets. The number of band layers in the two windings is always the same, and no relative movement takes place between the individual band layers, which is an important advantage.

Since during the filling process band is continuously withdrawn from the storing machine to the processing machine in the direction of the arrow 12, filling of the storing machine must take place appropriately rapidly; i.e., the loading basket 17 with the loading roller 22 must rotate appropriately rapidly. The coordination of these speeds can be effected with conventional electrical or electronic measures.

Withdrawal of the band 15 from the storing machine in the direction of the arrow 12 is effected via the supporting and direction-changing roller 24 from the inside of the belt winding 29, which is located on the inner basket 18. Since at the same time the loading basket 17, via the loading roller 22, is continuously winding further band layers from the outside onto the inner band winding 29, the outer diameter of this winding continuously increases. The inner diameter of the winding 29, which similarly increases due to the continuous band withdrawal in the direction of the arrow 12, is compensated for by the aforementioned pneumatic expansion of the supporting rollers 23 of the inner basket 18. However, at the same time the diameter of the outer band winding 28 also increases, this winding being located on the supporting rollers 21 of the outer basket 17. This occurs because the layers which are placed by the loading roller 22 from the outside onto the inner belt winding 29 are removed from the inside of the belt winding 28 of the loading basket 17, while from the outside additional band layers are placed onto the band winding 28 from the coil 14 via the auxiliary roller 26. To compensate for the increase of the inner diameter of the band winding 28, the supporting rollers 21 as well as the loading roller 22 are also pneumatically expandable.

Band withdrawal, expansion of the rollers of the inner and outer baskets, as well as drawing-in of the band takes place simultaneously in a coordinated manner by means of the rotation of the loading basket, so that appropriate clearance of motion of all parts results.

Figure 2:
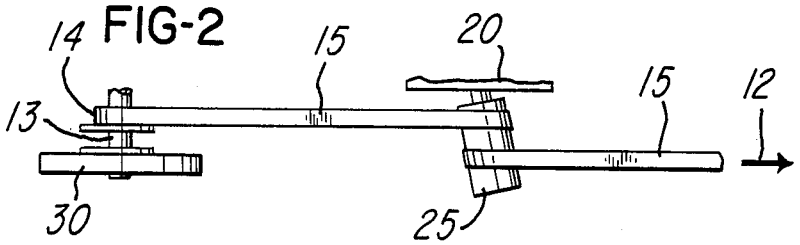
FIG. 2 is a view of the band path from above.

As soon as the outer diameter of the outer band winding 28 has achieved a certain value, advancement of the loading basket 17 is automatically discontinued, i.e. the storing machine has now achieved its greatest filling level. The stopper 27 is activated and firmly holds in place the remainder of the band 15 which is entering from the now empty coil 14, so that the start of the next coil can be welded thereto. To accelerate this process, the uncoiling device 13 is conventionally designed in such a way that the new coil is already in readiness when the old band is nearly to an end. FIG. 2 shows the disposition of a new coil 30.

Even while the new band from the coil 30 is being welded on, the processing machine continues to pull the band from the storing machine in the direction of the arrow 12 at the same speed as before. However, since feeding of the band at the inlet side via the auxiliary roller 26 is stopped, the loading basket 17 with the loading roller 22 is, of course, now pulled along in the opposite direction, i.e. in the clockwise direction, resulting in the effect that the stored band 15, winding for winding, is rewound via the loading roller 22 from the inside of the outer winding 28 to the outer side of the inner winding 29. In so doing, both of the band windings become continuously thinner, and after numerous rotations to the right the loading roller 22 finally only has a single band layer left to handle before it returns in an electrically controlled manner, and while being gently slowed down, to its rest or by-pass position shown in FIG. 1. Thus the storing machine is emptied, the stopper 27 is automatically released at the right time, and the machine operates with the band of the new coil 30 in by-pass operation again until the next storing cycle is initiated.

As soon as the loading basket 17 stops again and the band 15 passes through the roller baskets without contacting the supporting rollers 21 and 23, the latter are returned from their expanded position into their starting position.

If the new coil 30 has different values, especially a different structural strength and a different inner diameter, it is merely necessary to change the control values for initiating storage, for the advancement and slowdown moments of the loading basket, and for the expansion pressures of the rollers of the roller baskets 17, 18; this can easily be accomplished with the aid of the aforementioned charts. If the width of the band also changes, the lateral guide rollers, which are not illustrated in the drawing, must additionally and in a conventional manner be adjusted. Nonetheless, the time consumed for a complete changeover is approximately only ten minutes.

Figure 3:
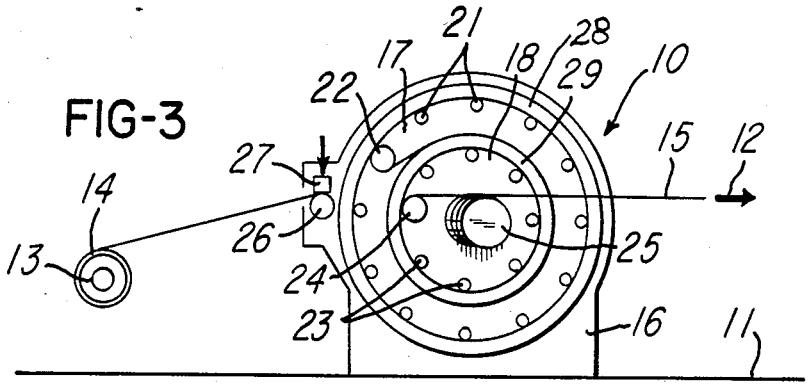
FIG. 3 is a side view of the inventive band storing machine in a view similar to that of FIG. 1, but with the coil nearly empty and the machine in storing operation.

If necessitated by local conditions, the loading basket-band storing machine 10 can operate also in the reverse direction in contrast to the illustration in FIGS. 1–3. In other words, the band is conveyed to the processing machine from the right to the left, so that as the storing machine is being filled, the loading basket rotates in a counterclockwise direction. Another possible alternative is to dispose the mounting plates 19, 20, and hence the roller baskets 17, 18, so that they are horizontal, whereby it is then no longer necessary to have an upper band guide, nor to make the latter adjustable to the rollers.

Since the band is conveyed only by being pulled, and in particular during by-pass operation is pulled through the processing machine and during storing operation is pulled via the rotating loading roller 22, the necessity to have a mechanical adjustment of the band storing machine to a changed band thickness is eliminated. Rather, it is necessary only to adapt to the pertaining drive power; for this purpose a conventional potentiometer or similar device is sufficient. Very thin bands can be also readily stored, since due to the exclusive pulling conveyance such bands cannot crease, i.e. the minimum band thickness which can be processed is limited only by the strength of the material. Since no relative movements between the layers of the windings take place, tearing of the band is practically precluded.

FIG. 4 shows the positions of the relevant operating parts of the roller baskets 17, 18, and in particular the supporting, loading, and direction-changing rollers 21, 22, 23, 24 as well as the band 15 and the band windings 28, 29; these parts are illustrated diagrammatically. The positions have the following meanings:

A = The minimum inner basket dimension during by-pass operation at the start of the storing cycle B = Minimum loading basket dimension during by-pass operation at the start of the storing cycle C = Greatest travel of the inner basket 18

D = Greatest travel of the loading basket 17

E = Greatest dimension of the inner band winding 29 at the end of the filling process F = The processing machine has withdrawn the band 15 to this point at the end of the filling process G = The greatest dimension of the inner basket 18 at the end of the storing cycle when the storing machine is empty H = Position of the loading basket 17 at the end of the filling process J = Greatest dimension of the loading basket 17 at the end of the storing cycle when the storing machine is empty.

The directional arrows at the three positions of the loading rollers 22 indicate in which direction the loading basket 17 with the loading roller 22 rotates in the respective phase of the storing cycle.

The present invention is, of course, in no way restricted to the specific disclosure of the specification and drawings, but also encompasses any modifications within the scope of the appended claims.

What I claim is:

1. A band storing machine for temporarily storing, as needed, a band of material in a continuously operating process line of a processing machine; said band storing machine comprising:

an unwinding location from which said band can be fed into said band storing machine;

two concentrically arranged roller baskets, namely an outer basket and an inner roller basket, for winding up said band during a storing operation; said outer roll basket being rotatably disposed about said inner roller basket; said inner basket and outer roller basket having rollers being arranged expandable in that each roller of the baskets can be moved to a predetermined extent along a radial line on mounting plate means therewith whereby expansion of said rollers when effected approximately follows increasing diameters of band winding and also forming a circular disk therewith, and when storage of said band in said band storing machine is not required, said band being guided therethrough from said unwinding location in such a way that the plane of said band is essentially at right angles to said circular disk of said inner and outer roller baskets; this operation being called a by-pass operation;

a lateral displacement guide, which is disposed in said inner roller basket and via which withdrawal of said band from said band storing machine to said processing machine is effected;

said rollers including at least one loading roller mounted on said outer roller basket; when storage of said band in said band storing machine is required, said outer roller basket rotates as a loading basket, with said band being pulled and wound onto said inner and outer roller baskets by means of said at least one loading roller;

said band storing machine including on at least one side thereof, and externally of said outer roller basket between it and said unwinding location, a direction-imparting auxiliary roller which is disposed in the straight line of the by-pass guidance of said band as well as including, ahead of the entry of said band into said roller baskets, a band stopper which is adapted to cooperate with said auxiliary roller;

those surfaces of said lateral displacement guide and said auxiliary roller which guide said band being disposed in the same plane, wherein said band passes during said by-pass operation directly without deflection from said auxiliary roller to said lateral displacement guide.

2. A band storing machine according to claim 1, in which said inner roller basket includes inner rollers which are intended for support of an inner band winding; and which includes a supporting and direction-changing roller which is disposed in said inner roller basket at that location where said band enters the latter; said supporting and direction-changing roller having an operational surface which is aligned with the by-pass plane and which, during a storing operation of said band storing machine, changes the direction of said band as it is withdrawn from said inner band winding and passes to said lateral displacement guide.

3. A band storing machine according to claim 2, in which, during a by-pass operation, said at least one loading roller is disposed, in readiness for a storing operation, near said supporting and direction-changing roller of said inner roller basket and above said band.

* * * * *